US009073739B2

(12) United States Patent
Woods et al.

(10) Patent No.: US 9,073,739 B2
(45) Date of Patent: Jul. 7, 2015

(54) CONTROLLER FOR RESTRICTING MOVEMENT OF A LOAD HANDLING APPARATUS

(75) Inventors: Sam Woods, Staffordshire (GB); Neil McKane, Rocester (GB); Kevin W. Ford, Cheshire (GB)

(73) Assignee: J.C. BAMFORD EXCAVATORS LIMITED, Uttoxeter (GB)

( * ) Notice: Subject to any disclaimer, the term of this patent is extended or adjusted under 35 U.S.C. 154(b) by 183 days.

(21) Appl. No.: 13/823,271

(22) PCT Filed: Sep. 12, 2011

(86) PCT No.: PCT/GB2011/051699

§ 371 (c)(1),
(2), (4) Date: Nov. 8, 2013

(87) PCT Pub. No.: WO2012/035324

PCT Pub. Date: Mar. 22, 2012

(65) Prior Publication Data

US 2014/0058636 A1 Feb. 27, 2014

(30) Foreign Application Priority Data

Sep. 14, 2010 (GB) ..... 1015281.7

(51) Int. Cl.
*B66F 17/00* (2006.01)
*B66C 23/90* (2006.01)
(Continued)

(52) U.S. Cl.
CPC ..... *B66F 17/00* (2013.01); *B66F 9/0655* (2013.01); *B66F 17/003* (2013.01); *E02F 3/286* (2013.01); *E02F 9/2033* (2013.01); *E02F 9/24* (2013.01); *E02F 9/26* (2013.01)

(58) Field of Classification Search
CPC ..... B66F 17/00; B66F 17/003; B66F 9/0655; E02F 3/286; E02F 9/2033; E02F 9/24; E02F 9/26
See application file for complete search history.

(56) References Cited

U.S. PATENT DOCUMENTS 3,680,714 A 8/1972 Holmes
4,042,135 A * 8/1977 Pugh et al. ..... 414/718
(Continued)

FOREIGN PATENT DOCUMENTS

DE 11 62 987 B 2/1964
EP 0 466 046 A1 1/1992
(Continued)

OTHER PUBLICATIONS

International Search Report for PCT/GB2011/051699, dated Nov. 14, 2011.
(Continued)

*Primary Examiner* — Michael J Zanelli
(74) *Attorney, Agent, or Firm* — Marshall, Gerstein & Borun LLP

(57) ABSTRACT

A controller for use with a machine comprising a machine body, and a load handling apparatus coupled to the machine body and moveable by a movement actuator with respect to the machine body, the controller being configured to receive a signal representative of the position of the load handling apparatus with respect to the machine body and a signal representative of a moment of tilt of the machine, wherein the controller is further configured to issue a signal for use by an element of the machine including the movement actuator, which in response to the signal issued by the controller, is configured to restrict or substantially prevent a movement of the load handling apparatus when a value of the signal representative of the moment of tilt reaches a threshold value, the threshold value being dependent on the signal representative of the position of the load handling apparatus with respect to the machine body.

17 Claims, 7 Drawing Sheets

(51) Int. Cl.

| | |
|---|---|
| ***E02F 9/24*** | (2006.01) |
| ***B66F 9/065*** | (2006.01) |
| ***E02F 3/28*** | (2006.01) |
| ***E02F 9/20*** | (2006.01) |
| ***E02F 9/26*** | (2006.01) |

(56) References Cited

U.S. PATENT DOCUMENTS

| | | | | |
|---|---|---|---|---|
| 5,224,815 | A | 7/1993 | Abels et al. | |
| 5,730,305 | A | 3/1998 | Ichiba et al. | |
| 6,991,119 | B2 * | 1/2006 | Puszkiewicz et al. | 212/277 |

FOREIGN PATENT DOCUMENTS

| | | | |
|---|---|---|---|
| FR | 2 750 972 | A1 | 1/1998 |
| JP | 2001-226096 | A | 8/2001 |
| JP | 2005-089138 | A | 4/2005 |
| JP | 2006-160502 | A | 6/2006 |
| JP | 2006-168871 | A | 6/2006 |
| WO | WO-2004/007339 | | 7/2003 |

OTHER PUBLICATIONS

Written Opinion for PCT/GB2011/051699, dated Nov. 14, 2011.

Search Report for GB 1015281.7, dated Jan. 12, 2011.

English translation of First Office Action, State Intellectual Property Office of the People's Republic of China, Chinese patent application No. 201180044141.8, dated Sep. 17, 2014.

Australian Patent Examination Report for Australian Application No. 2011303666, dated Aug. 27, 2014.

* cited by examiner

CONTROLLER FOR RESTRICTING MOVEMENT OF A LOAD HANDLING APPARATUS

FIELD OF THE INVENTION

The present invention relates to a controller for a machine including a load handling apparatus, a machine including such a controller, and a control method.

BACKGROUND OF THE INVENTION

Machines including a load handling apparatus typically include a front and a rear axle supporting a machine body on which the load handling apparatus is mounted. Wheels are normally coupled to the front and rear axles, the wheels being configured to engage the ground and permit movement of the machine across the ground.

The load handling apparatus includes, for example, an extendable lifting arm moveable by one or more actuators with respect to the machine body. The lifting arm includes a load carrying implement to carry a load such that a load carried by the load carrying implement can be moved with respect to the machine body by the lifting arm.

Movement of the load produces a moment of tilt about an axis of rotation of one of the front or rear axles. Alternatively, a moment of tilt may be induced about another axis where, for example, stabilisers are used to stabilise the body relative to the ground during load handling operations.

Extension of the lifting arm in forwards direction, particularly when carrying a load, induces a moment of tilt about the axis of rotation of the front axle. As a result the portion of the machine (and load) weight supported by the rear axle decreases.

In order to ensure that the machine does not rotate about the front axle to such an extent that the wheels coupled to the rear axle are lifted from the ground surface (i.e. to ensure that the machine does not tip), when the load on the rear axle reduces to a threshold level, a safety control prevents further movement of the lifting arm. An example of such a machine can be found in EP1532065.

A problem arises because, in order to remain within safety limits, the threshold level which is selected for use by the safety control is overly restrictive for certain lifting arm positions—preventing the lifting arm from being moved into positions which do not actually risk the tipping of the machine.

It will be appreciated that this and similar problems apply to other machines too.

SUMMARY OF THE INVENTION

Accordingly, an aspect of the present invention provides a controller for use with a machine comprising a machine body, and a load handling apparatus coupled to the machine body and moveable with respect to the machine body, the controller being configured to receive a signal representative of the position of the load handling apparatus with respect to the machine body and a signal representative of a moment of tilt of the machine, wherein the controller is further configured to issue a signal for use by an element of the machine to control an operation of the machine when a value of the signal representative of the moment of tilt reaches a threshold value, the threshold value being dependent on the signal representative of the position of the load handling apparatus with respect to the machine body.

The element of the machine may include a movement actuator which, in response to the signal issued by the controller, is configured to restrict or substantially prevent a movement of the load handling apparatus.

The element of the machine may include an indicator of the machine which, in response to the signal issued by the controller, is configured to display and/or sound a warning.

The controller may be further configured to receive a signal representative of whether one or more stabilisers of the machine are deployed, and the threshold value may be further dependent on the signal representative of whether one or more of the stabilisers of the machine are deployed.

The signal representative of the position of the load handling apparatus may be a signal representative of an angle of rotation of a lifting arm of the load handling apparatus with respect to the machine body about a substantially fixed pivot.

The signal representative of the moment of tilt of the machine may be a signal representative of the load on an axle of the machine.

The threshold value may include a first threshold value associated with one or more predetermined positions of the load handling apparatus and a second threshold value associated with one or more other predetermined positions of the load handling apparatus.

The threshold value may be proportional or substantially proportional to the signal representative of a position of the load handling apparatus over a range of positions of the load handling apparatus.

The range of positions of the load handling apparatus may be between a first and a second position of the load handling apparatus, and at least one different threshold value may be used when the position of the load handling apparatus is outside of the range.

Another aspect of the invention provides a machine including a controller as above.

Another aspect of the present invention provides a method of controlling a machine comprising a machine body, and a load handling apparatus coupled to the machine body and moveable with respect to the machine body, the method comprising: receiving a signal representative of the position of the load handling apparatus with respect to the machine body and a signal representative of a moment of tilt of the machine; comparing signal representative of the moment of tilt with a threshold value, the threshold value being dependent on the signal representative of the position of the load handling apparatus with respect to the machine body; and issuing a signal for use by an element of the machine to control an aspect of an operation of the machine when the signal representative of the moment of tilt reaches the threshold value.

The method may further include restricting or substantially preventing a movement of the load handling apparatus in response to the issued signal.

The method may further include displaying and/or sounding a warning in response to the signal issued by the controller.

The method may further include receiving a signal representative of whether one or more stabilisers of the machine are deployed, wherein the threshold value may be further dependent on the signal representative of whether one or more of the stabilisers of the machine are deployed.

The signal representative of the position of the load handling apparatus may be a signal representative of an angle of rotation of a lifting arm of the load handling apparatus with respect to the machine body about a substantially fixed pivot.

The signal representative of the moment of tilt of the machine may be a signal representative of the load on an axle of the machine.

The threshold value may include a first threshold value associated with one or more predetermined positions of the load handling apparatus and a second threshold value associated with one or more other predetermined positions of the load handling apparatus.

The threshold value may be proportional or substantially proportional to the signal representative of a position of the load handling apparatus over a range of positions of the load handling apparatus.

The range of positions of the load handling apparatus may be between a first and a second position of the load handling apparatus, and at least one different threshold value may be used when the position of the load handling apparatus is outside of the range.

BRIEF DESCRIPTION OF THE DRAWINGS

Embodiments of the present invention are described herein, by way of example, with reference to the accompanying drawings, in which.

DETAILED DESCRIPTION

Figure 1:
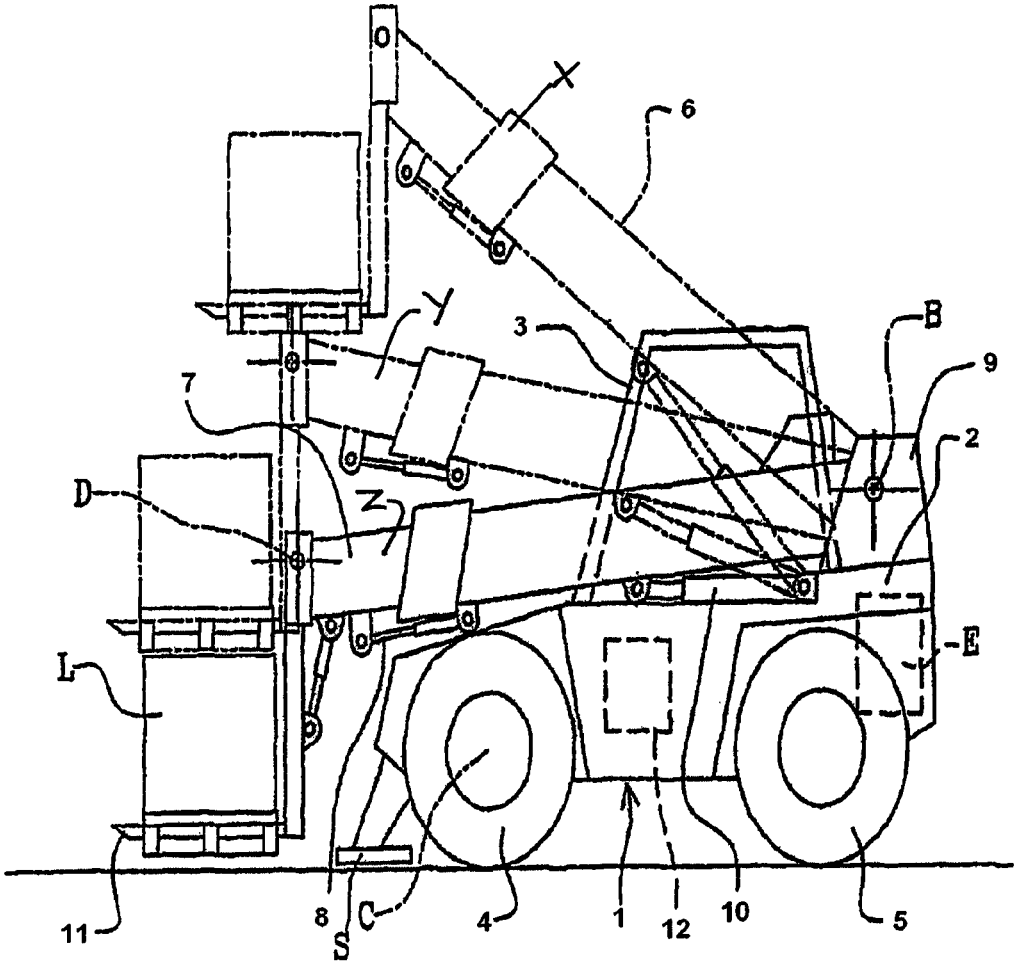
FIG. 1 shows a machine.

With reference to FIG. 1, an embodiment of the present invention includes machine 1 which may be a load handling machine. The machine 1 includes a machine body 2 which may include, for example, an operator's cab 3 from which an operator can operate the machine 1.

In an embodiment, the machine 1 has a first and a second axle, each axle being coupled to a pair of wheels (two wheels 4,5 are shown in FIG. 1 with one wheel 4 connected to the first axle and one wheel 5 connected to the second axle). The first axle may be a front axle and the second axle may be a rear axle. One or both of the axles may be coupled to an engine E which is configured to drive movement of one or both pairs of wheels. Thus, the wheels may contact a ground surface and rotation of the wheels may cause movement of the machine with respect to the ground surface.

In an embodiment, at least one of the first and second axles is coupled to the machine body 1 by a pivot joint (not shown) located at substantially the centre of the axle such that the axle can rock about a longitudinal axis of the machine 1—thus, improving stability of the machine 1 when moving across uneven ground. It will be appreciated that this effect can be achieved in other known manners.

A load handling apparatus 6,7 is coupled to the machine body 2. The load handling apparatus 6,7 may be mounted by a mount 9 to the machine body 2. In an embodiment, the load handling apparatus 6,7 includes a lifting arm 6,7.

The lifting arm 6,7 may be a telescopic arm having a first section 6 connected to the mount 9 and a second section 7 which is telescopically fitted to the first section 6. In this embodiment, the second section 7 of the lifting arm 6,7 is telescopically moveable with respect to the first section 6 such that the lifting arm 6,7 can be extended and retracted. Movement of the first section 6 with respect to the second section 7 of the lifting arm 6,7 may be achieved by use of an extension actuator 8 which may be a double acting hydraulic linear actuator. One end of the extension actuator 8 is coupled to the first section 6 of the lifting arm 6,7 and another end of the extension actuator 8 is coupled to the second section 7 of the lifting arm 6,7 such that extension of the extension actuator 8 causes extension of the lifting arm 6,7 and retraction of the extension actuator 8 causes retraction of the lifting arm 6,7. As will be appreciated, the lifting arm 6,7 may include a plurality of sections: for example, the lifting arm 6,7 may comprise two, three, four or more sections. Each arm section may be telescopically fitted to at least one other section.

The lifting arm 6,7 can be moved with respect to the machine body 2 and the movement is preferably, at least in part, rotational movement about the mount 9 (about pivot B of the lifting arm 6,7). Rotational movement of the lifting arm 6,7 with respect to the machine body 2 is, in an embodiment, achieved by use of a lifting actuator 10 coupled, at one end, to the first section 6 of the lifting arm 6,7 and, at a second end, to the machine body 2. The lifting actuator 10 may be a double acting hydraulic linear actuator.

FIG. 1 shows the lifting arm 6,7 positioned at three positions, namely X, Y and Z. When positioned at position X the angle between the lifting arm and a horizontal line is 44 degrees. When positioned at position Y the angle is 14 degrees. When positioned at position Z the angle is −8 degrees. Clearly, the lifting arm can be positioned at an angle higher than 44 degrees, at any angle between 44 degrees and −8 degrees, and at an angle lower than −8 degrees. As will be appreciated, when the lifting arm is positioned relatively close to the ground it is at a relatively small angle and when it is positioned relatively remotely from the ground it is at a relatively high angle.

A load handling implement 11 may be located at a distal end of the lifting arm 6,7. The load handling implement 11 may include a fork-type implement which may be rotatable with respect to the lifting arm 6,7 about a pivot D-movement of the load handling implement 11 may be achieved by use of a double acting linear hydraulic actuator coupled to the load handling implement 11 and the distal end of the section 7 of the lifting arm 6,7.

When the machine 1 lifts a load L supported by the load handling implement 11, the load L will produce a moment about an axis of the machine 1 which causes the machine to tend to tilt about that axis. The moment is, therefore, referred to herein as a moment of tilt. In the depicted example, this axis of the machine 1 about which the machine 1 is likely to tilt is axis C—i.e. about the first (or front) axle.

Figure 2:
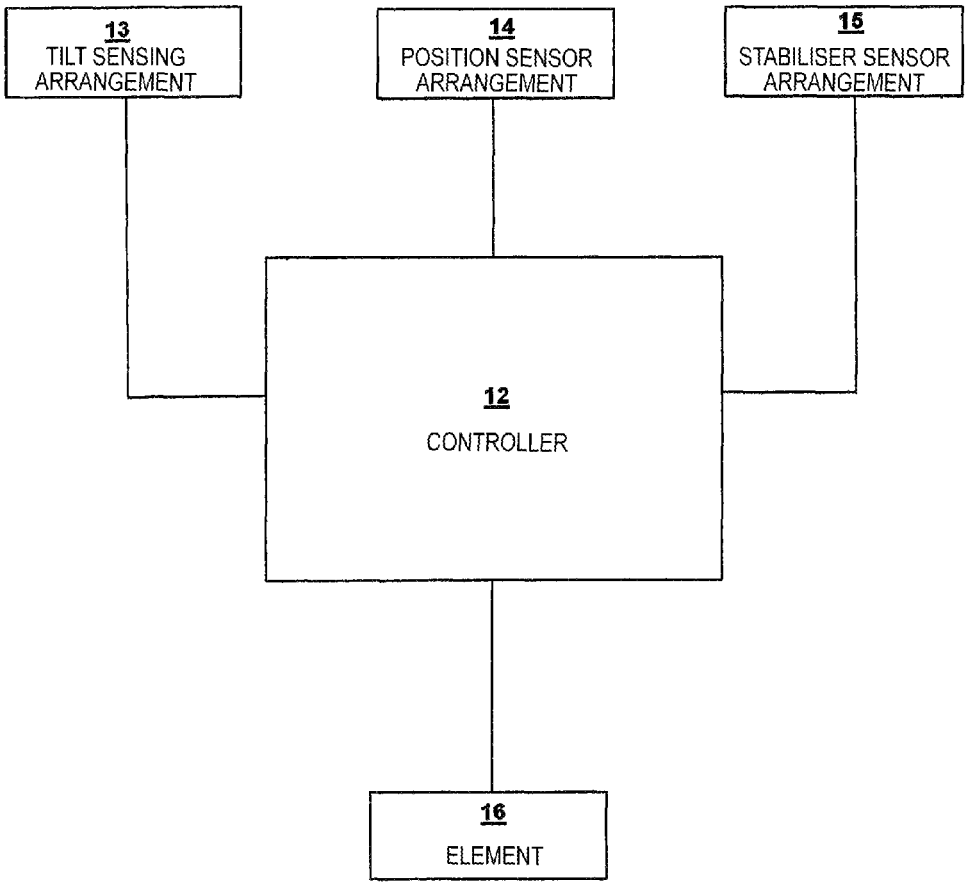
FIG. 2 shows a controller.

A tilt sensing arrangement 13 (see FIG. 2) is provided and is configured to sense a parameter which is representative of a moment of tilt of the machine about an axis.

The tilt sensing arrangement 13 is further configured to issue a signal to the controller 12 such that a moment of tilt of the machine about an axis can be determined. In an embodiment, the tilt sensing arrangement 13 includes a strain gauge coupled to an axle of the machine 1. In an embodiment, the tilt sensing arrangement 13 includes a load cell located between the machine body 2 and an axle and configured to sense the load (or weight) on the axle. The tilt sensing arrangement 13 may be coupled to or otherwise associated with the second (or rear) axle.

The tilt sensing arrangement 13 may, in an embodiment, include several sensors which sense different parameters and use these parameters to generate a signal such that a moment of tilt of the machine 1 can be determined.

The tilt sensing arrangement 13 may take other forms—as will be appreciated.

A position sensor arrangement 14 (see FIG. 2) is also provided and is configured to sense a parameter representative of a position of at least a portion of the load handling apparatus 6,7 with respect to the machine body 2.

The position sensor arrangement 14 is further configured to issue a signal to the controller 12 representative of a position of at least a portion of the load handling apparatus 6,7 with respect to the machine body 2. The position sensor arrangement 14 may sense a position of at least a portion of the load handling apparatus 6,7 with respect to the machine body 2 or may, for example, sense a position of at least a portion of the load handling apparatus 6,7 with respect to a predetermined axis (the predetermined axis having a substantially known or assumed positional relationship with the machine body 2).

In an embodiment, the position sensor arrangement 14 is configured to issue a signal representative of an orientation of a portion of the load handling apparatus 6,7.

The position sensor arrangement 14 may be a series of switches associated with the load handling apparatus 6,7 and configured to be actuated by movement of the load handling apparatus 6,7 with respect to the machine body 2. The position sensor arrangement 14 may include a series of markings on a part of the lifting actuator 10 and a reader configured to detect the or each marking. The lifting actuator 10 may be arranged such that extension of the lifting actuator 10 causes one or more of the series of markings to be exposed for detection by the reader. If the position of the markings on the actuator 10 is known, then the extension of the lifting actuator 10 can be determined.

It will be appreciated that other position sensor arrangements are possible.

In an embodiment, the position sensor arrangement 14 is configured to issue a signal representative of an angle of a lifting arm 6,7 of the load handling apparatus 6,7 with respect to the machine body 2. In an embodiment, this signal may be the angle of the lifting arm 6,7 with respect to the machine body 2. In an embodiment, the position sensor arrangement 14 is configured to issue a signal representative of an angle of rotation of a lifting arm 6,7 of the load handling apparatus 6,7 about a substantially fixed pivot (e.g. pivot B).

A controller 12 (see FIGS. 1 and 2) is provided which is configured to receive a signal from the tilt sensing arrangement 13 and the position sensor arrangement 14—these signals being representative of a position of the load handling apparatus 6,7 and a moment of tilt of the machine 1. The controller 12 is coupled to at least one actuator which controls at least one movement of the load handling apparatus 6,7 with respect to the machine body 2. The controller 12 is configured to issue a signal to stop or restrict a movement of the load handling apparatus 6,7 when a condition or conditions are met—as described below.

When a load L is supported by the load handling implement 11, the weight of the load L is counterbalanced by the weight of the machine 1. However, if the moment of tilt increases, the machine 1 may become unstable as the weight on the second axle decreases—i.e. the machine 1 may tip about axis C.

The controller 12 of the machine 1 is configured to receive a signal indicative of the moment of tilt—which may, for example, be the load (or weight) on the second (or rear) axle. In addition, the controller 12 is configured to receive a signal indicative of a position of the load handling apparatus—for example the angle of the lifting arm 6,7 with respect to the machine body 2.

In an embodiment (see FIG. 6 for example), the controller 12 includes a first and a second stored threshold value—the first and second threshold values being different. When the signal representative of a position of the load handling apparatus 6,7 indicates that the load handling apparatus 6,7 is in a first position with respect to the machine body 2, the controller compares the signal representative of the moment of tilting with the first threshold value. The controller 12 may then issue a signal or command to restrict or substantially prevent a movement of the load handling apparatus 6,7 if, for example, the signal representative of the moment of tilting is close to or is approaching the first threshold value.

When the signal representative of a position of the load handling apparatus 6,7 indicates that the load handling apparatus 6,7 is in a second position with respect to the machine body 2, the controller compares the signal representative of the moment of tilting with the second threshold value. The controller 12 may then issue a signal or command to restrict or substantially prevent a movement of the load handling apparatus 6,7 if, for example, the signal representative of the moment of tilting is close to or is approaching the second threshold value.

Restricting or substantially preventing a movement of the load handling apparatus 6,7 may include, for example, restricting or stopping the flow of hydraulic fluid into and out of a movement actuator such as the lifting actuator 10. In an embodiment, restricting or substantially preventing a movement of the load handling apparatus 6,7 includes restricting or substantially preventing a movement of the load handling apparatus 6,7 in one or more directions. In an embodiment in which the load handling apparatus 6,7 includes a lifting arm 6,7, restricting or substantially preventing a movement of the lifting arm 6,7 may prevent lowering of the arm 6,7 but may allow raising and/or retraction of the lifting arm 6,7.

Thus, the threshold value which is used for the comparison by the controller 12 is dependent on the position of the load handling apparatus 6,7. This dependency may take many different forms—see below.

Restricting or substantially preventing a movement of the load handling apparatus 6,7 is intended to seek to reduce the risk of the machine tipping by preventing or restricting a movement which would otherwise tip—or risk tipping—the machine 1. The use of a threshold value which is dependent on a position of the load handling apparatus 6,7 is intended to seek to avoid restricting movement of the load handling apparatus 6,7 needlessly when there is little or no risk of tipping the machine 1 or moving out of safety limits.

The restriction or substantial prevention of a movement of the load handling apparatus 6,7 may include, for example, the progressive slowing of a movement of at least a part of the load handling apparatus 6,7—for example, slowing the speed of movement of a lifting arm 6,7 to a stop.

In an embodiment, the first and second threshold values are selected dependent on the position of the load handling apparatus 6,7. A single threshold value may apply to several different positions of the load handling apparatus 6,7 with respect to the machine body 2. The threshold values may be proportional to or substantially proportional to a position of the load handling apparatus 6,7 with respect to the machine body 2—for example, an angular position of a lifting arm 6,7 of the load handling apparatus 6,7 with respect to the machine body 2 (see FIGS. 6 and 7). The proportional or substantially proportional dependency of the threshold value on the position of the load handling apparatus 6,7 may be limited to a range of positions of the load handling apparatus 6,7 (see FIG. 5) or may be over the entire range of permitted or possible positions of the load handling apparatus 6,7 (see FIG. 4).

For example, the machine 1 may have a load handling apparatus 6,7 which includes a lifting arm 6,7 and position sensor arrangement 14 may include a sensor configured to sense the angle of the lifting arm 6,7 with respect to the machine body 2 (or a parameter representative of the angle of the lifting arm 6,7). The threshold value used by the controller 12 may be selected dependent on the angle of the lifting arm 6,7 with respect to the machine body 2. A first threshold value may be used for angles below a lower limit and a second threshold value may be used for angles above an upper limit.

If the lower and upper limits are at different angles, then a variable threshold value may be used between the upper and lower limits (the variable threshold value may be proportional to the position of the lifting arm 6,7). The first threshold value is preferably lower than the second threshold value.

In an embodiment, there is a plurality of threshold values each with a respective load handling apparatus position associated therewith. The threshold values and associated load handling apparatus positions may be stored in a lookup table which can be accessed by the controller.

In an embodiment, the load sensor arrangement senses the weight on the second (or rear) axle of the machine 1. In this example embodiment, a typical load on the second axle of the machine 1 is 4000 kg to 6000 kg. A first threshold value for the controller 12 is selected to be about 1000 kg for lifting arm angles with respect to the horizontal (with the machine in an typical orientation) of less than about 40° (or less than about 25°-30° in another example), a second threshold value is selected to be about 3500 kg for lifting arm angles with respect to the horizontal of greater than about 60° (or greater than about 55° in another example). The threshold value for any angles between these angles (e.g. between 40° and 60° in one example) may be proportional or substantially proportional to the angle such that there is a substantially linear progression of the threshold value for a given angle from the first to the second threshold value between the specified angles (e.g. between 40° and 60° in one example).

The threshold values used for a particular machine will be dependent on the machine characteristics. For example, the threshold values may be dependent on the geometry of the machine, the mass of the machine, the geometry and mass of the load handling apparatus 6,7. The threshold values are selected in an attempt to prevent tipping of the machine during operation.

It will be appreciated that the selection of a threshold value for the moment of tilt dependent on the position of the load handling apparatus 6,7 allows the machine 1 to operate safely within a full range of movement.

Figure 4:
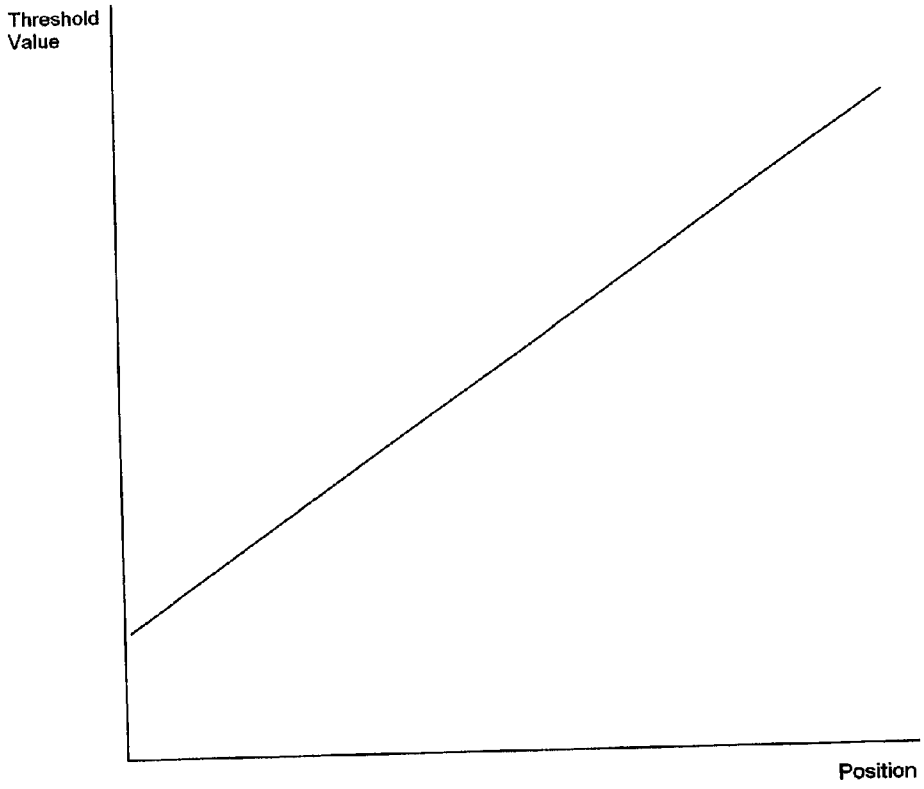
FIGS. 4 to 7 show threshold value and load handling apparatus position relationships.
Figure 5:
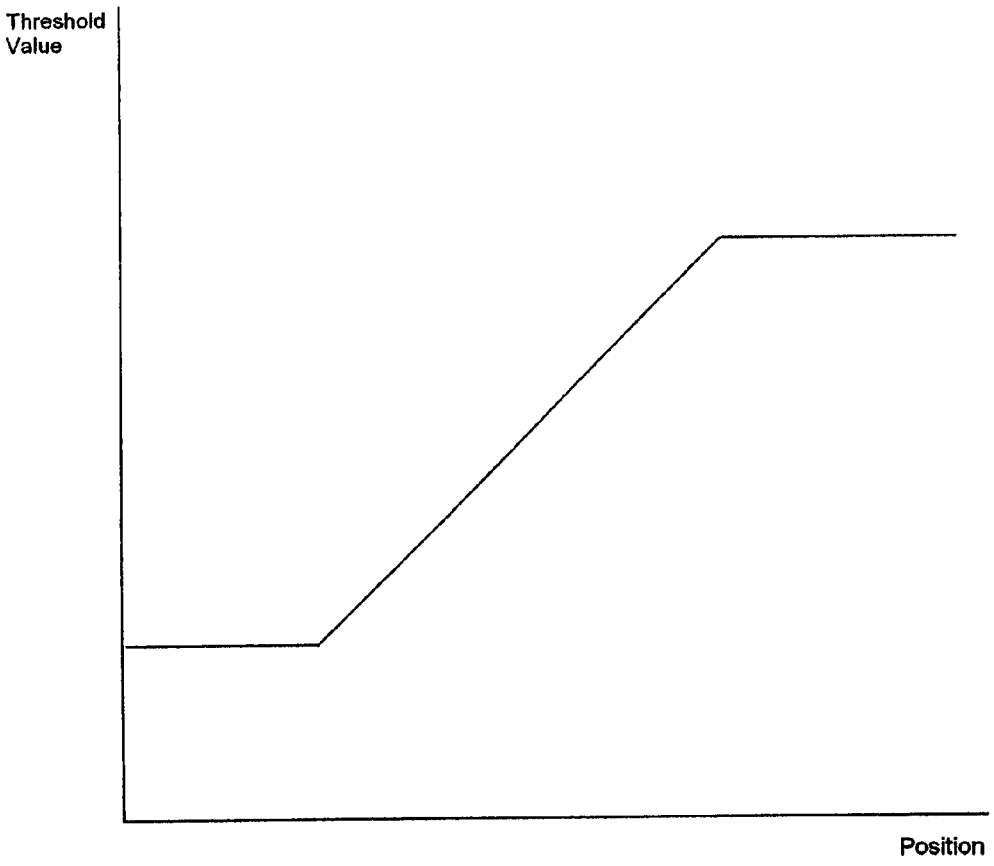
Figure 6:
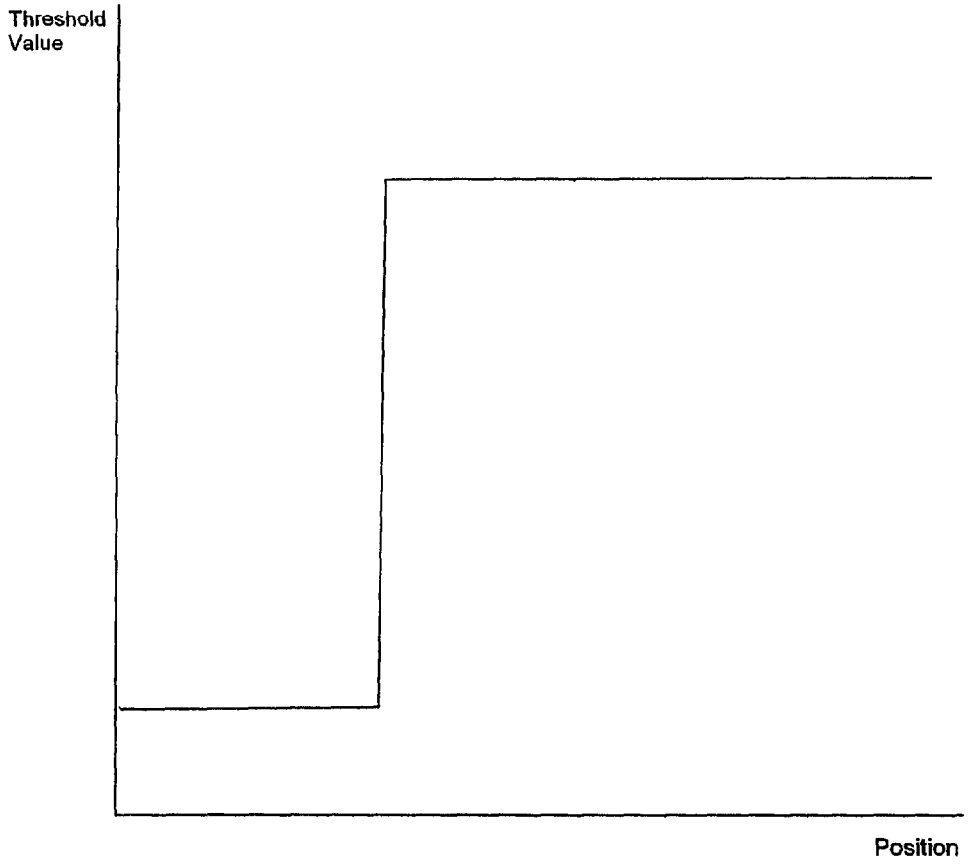
Figure 7:
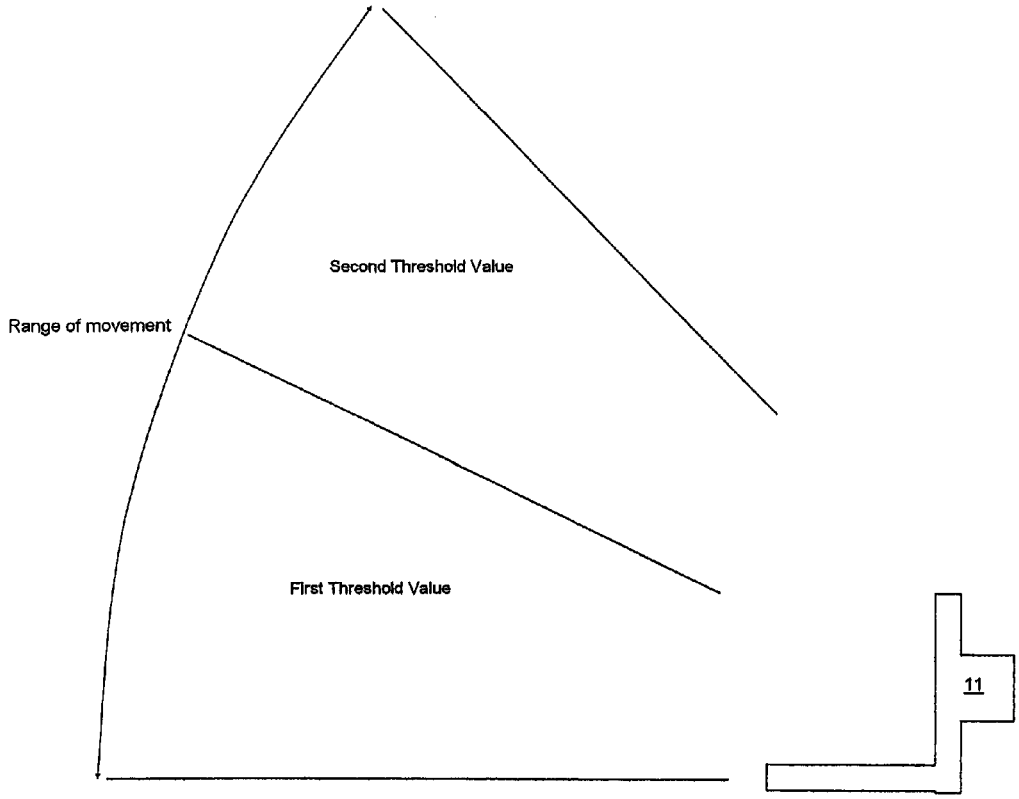

FIGS. 4 to 7 show a selection of examples of possible threshold values for different load handling apparatus positions. In FIG. 4, the threshold value is proportional to the position of the load handling apparatus 6,7. In FIG. 5, a first threshold value is used for a first range of positions of the load handling apparatus 6,7, a second threshold value is used for a second range of positions of the load handling apparatus 6,7, and the threshold value used for a given position of the load handling apparatus 6,7 between the first and second ranges varies in proportion to the position of the load handling apparatus 6,7. In FIG. 6, a first threshold value is used for a first range of positions of the load handling apparatus 6,7, a second threshold value is used for a second range of positions of the load handling apparatus 6,7. FIG. 7 is another representation of the relationship shown in FIG. 6 in the specific example of a load handling apparatus 6,7 comprising a lifting arm 6,7 which can move (about pivot B) with respect to the machine body 2 over a range of possible angles—with a first threshold value being used over a first range of angular movement and a second threshold value being used over a second range of angular movement.

In an embodiment, the machine 1 includes one or more stabilisers S which may be extended or retracted from the machine body 2. The or each stabiliser S preferably extends from a part of the machine body 2 which is towards the load handling implement 11 of the machine 1. There are preferably two stabilisers S and each stabiliser is preferably located adjacent a wheel which is coupled to the first (or front) axle. The or each stabiliser S is configured to be extended such it makes contact with a ground surface and restricts movement of the machine 1 about an axis (for example axis C) which may be induced by the moment of tilt caused by the load L.

If the machine 1 includes one or more stabilisers S, then the controller 12 may be further configured to receive a signal from a stabiliser sensor arrangement 15 (see FIG. 2), the signal being representative of whether or not the or each stabiliser has been deployed. If the or each stabiliser S has been deployed, then the threshold values used by the controller 12 may be different from those which are used without the or each stabiliser S deployed. The controller 12 may include a first set of threshold values for when the or each stabiliser S is not deployed and a second set of threshold values for when the or each stabiliser S is deployed. The threshold values used when the or each stabiliser S is deployed may generally follow the same principles as discussed above for the case when the or each stabiliser S is either not present or not deployed. The description above relating to the threshold value applies equally to the threshold value when the or each stabiliser S is deployed. The threshold values used when the or each stabiliser S is deployed may be higher than the threshold values used for corresponding positions of the load handling apparatus 6,7 when the or each stabiliser S is not deployed.

Figure 3:
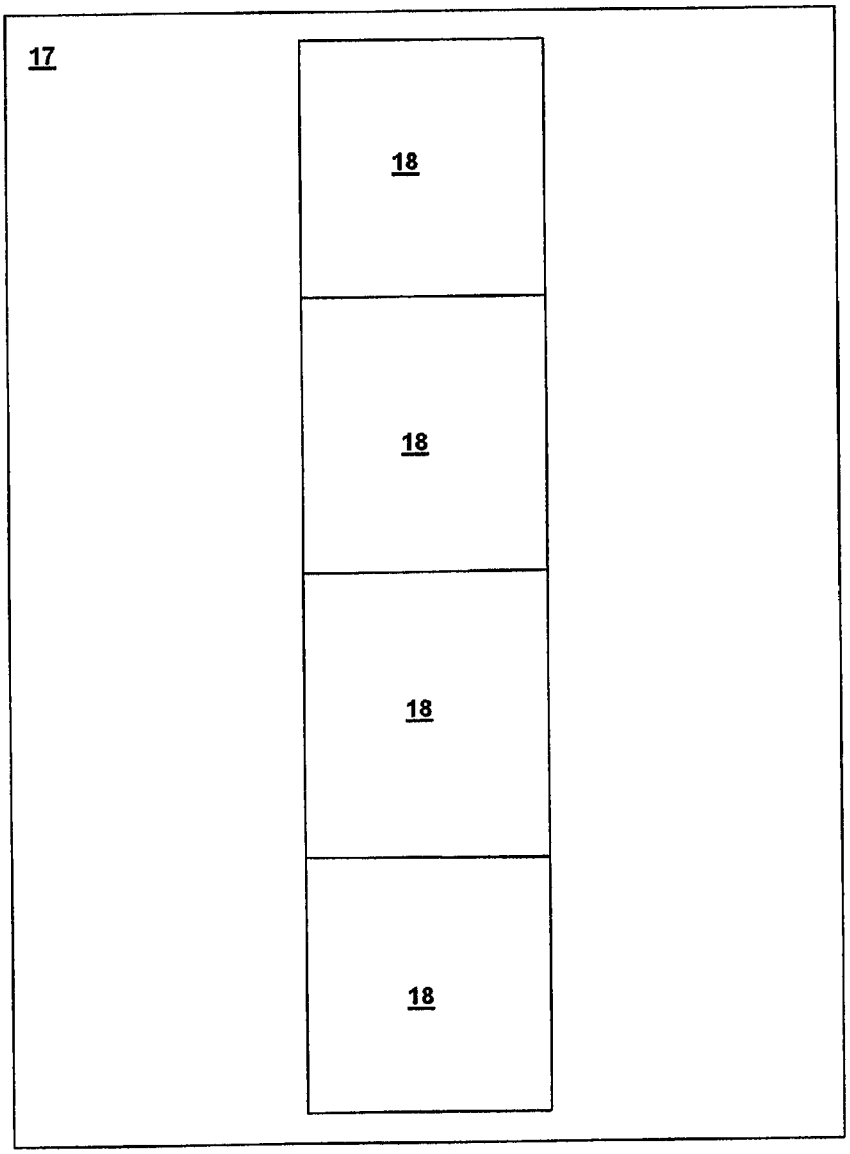
FIG. 3 shows an indicator.

In an embodiment, an indicator 17 (see FIG. 3) is provided in the cab 3 for the operator. The indicator 17 may be a visual indicator or and audible indicator or both. The indicator 17 preferably includes a plurality of lights 18 (which may be lamps or light emitting diodes—for example). The number of lights 18 which are lit is generally dependent on the signal representative of the moment of tilt as received by the controller 12. Control of the lights 18 may be achieved by the controller 12. In an embodiment, the indicator 17 sounds an alarm and an aspect of the alarm (e.g. pitch or frequency) may vary in general dependence on the signal representative of the signal representative of the moment of tilt as received by the controller 12. In particular, the controller 12 may issue a signal to control the indicator 17. The signal may be the same signal as is issued by the controller 12 to restrict or substantially prevent a movement of the load handling apparatus 6,7 or may be a further signal. In an embodiment, the indicator 17 receives the signal representative of the moment of tilt as is also received by the controller 12. The controller 12 may issue a signal to the indicator 17 which is used by the indicator 17 to determine the operation of the indicator 17. For example, the controller 12 may issue a scaling factor signal (see below) to the indicator 17 which the indicator 17 may apply to the signal representative of the moment of tilt; the resulting scaled signal may be used to operate the indicator 17.

The lights are, in an embodiment, colour coded—with one or more green lights being lit when that moment of tilt is below the relevant threshold value as determined by the controller 12 and one or more amber or red lights being lit (or flashed) when the relevant threshold value is close or is approaching. An alarm of the indicator 17 may be sounded, in an embodiment, when the relevant threshold is close or approaching. The alarm may be silent when the relevant threshold is not close or approaching.

In accordance with an embodiment, a scaling factor which is dependent on the signal representative of the position of the load handling apparatus 6,7 is applied to the signal representative of the moment of tilt in order to determine the number of lights 18 which are to be lit. This scaling factor may be inversely proportional to the signal representative of the position of the load handling apparatus 6,7. This use of a scaling factor may occur in the controller 12 or in the indicator 17.

Therefore, the moment of tilt which causes the indicator 17 to indicate that the machine 1 is at risk of tipping varies in dependence on the position of the load handling apparatus 6,7.

The dependence on the position of the load handling apparatus 6,7, seeks to ensure that the operation of the indicator 17 can be easily understood by the operator. If the indicator 17 operated solely based on the signal representative of the moment of tilt of the machine 1 then, for example, the number of lights 18 lit when the machine 1 is at risk of tipping would vary. This would be confusing for the operator.

The indicator 17 may take many different forms and need not be a plurality of lights 18 as described above but could be a numerical indicator which displays a numerical value representative of the stability of the machine 1. The indicator 17 also need not be in the cab 3 but may be provided elsewhere in a location in which it can be viewed and/or heard by an operator.

In an embodiment, the indicator 17 includes a light which flashes and/or an alarm that sounds when the controller 12 issues a signal to restrict or substantially prevent a movement of the load handling apparatus 6,7.

In an embodiment, the indicator 17 is provided and the controller 12 is coupled to the indicator 17. A signal issued by the controller 12 to the indicator 17 controls operation of the indicator 17 and the controller 32 may or may not also be operable to restrict or substantially prevent movement of the load handling apparatus 6,7.

It will be appreciated that a signal issued by the controller 12 is for use by an element 16 (see FIG. 2) of a machine 1 to control an aspect of an operation of the machine 1 and that two examples of that operation are: restricting or substantially preventing a movement of the load handling apparatus 6,7; and displaying and/or sounding a warning. Control of other operations is also possible. To this end, the controller 12 may be coupled to an element 16 of the machine which includes, for example, an indicator 17 or a device which restricts or substantially prevents a movement of the load handling apparatus 6,7 (which might be a movement actuator, a part thereof, or a control element for a movement actuator).

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A controller for use with a machine comprising a machine body, and a load handling apparatus coupled to the machine body and moveable by a movement actuator with respect to the machine body, the controller being configured to receive a signal representative of the position of the load handling apparatus with respect to the machine body and a signal representative of a moment of tilt of the machine, wherein the controller is further configured to determine when a value of the signal representative of the moment of tilt reaches a threshold value, the threshold value being dependent on the signal representative of the position of the load handling apparatus with respect to the machine body, and to issue a signal for use by an element of the machine including the movement actuator, which in response to the signal issued by the controller, is configured to restrict or substantially prevent a movement of the load handling apparatus.

2. A controller according to claim 1, wherein the element of the machine includes an indicator of the machine which, in response to the signal issued by the controller, is configured to display and/or sound a warning.

3. A controller according to claim 1, wherein the controller is further configured to receive a signal representative of whether one or more stabilisers of the machine are deployed, and the threshold value is further dependent on the signal representative of whether one or more of the stabilisers of the machine are deployed.

4. A controller according to claim 1, wherein the signal representative of the position of the load handling apparatus is a signal representative of an angle of the load handling apparatus with respect to the machine body.

5. A controller according to claim 1 wherein the threshold has a first value corresponding to a first angle of the load handling apparatus with respect to the machine body and the threshold has a second value corresponding to a second angle of the load handling apparatus with respect to the machine body, the first value being less than the second value and the first angle being less than the second angle.

6. A controller according to claim 1, wherein the signal representative of the moment of tilt of the machine is a signal representative of the load on an axle of the machine.

7. A controller according to claim 1, wherein the threshold value includes a first threshold value associated with one or more predetermined positions of the load handling apparatus and a second threshold value associated with one or more other predetermined positions of the load handling apparatus.

8. A controller according to claim 7, wherein the threshold value is proportional or substantially proportional to the signal representative of a position of the load handling apparatus over a range of positions of the load handling apparatus.

9. A controller according to claim 8, wherein the range of positions of the load handling apparatus is between a first and a second position of the load handling apparatus, and at least one different threshold value is used when the position of the load handling apparatus is outside of the range.

10. A method of controlling a machine comprising a machine body, and a load handling apparatus coupled to the machine body and moveable with respect to the machine body, the method comprising:

receiving a signal representative of the position of the load handling apparatus with respect to the machine body and a signal representative of a moment of tilt of the machine;

comparing signal representative of the moment of tilt with a threshold value, the threshold value being dependent on the signal representative of the position of the load handling apparatus with respect to the machine body; and issuing a signal for use by an element of the machine to restrict or substantially preventing a movement of the load handling apparatus in response to the issued signal when the signal representative of the moment of tilt reaches the threshold value.

11. A method according to claim 10, further comprising displaying and/or sounding a warning in response to the signal issued by a controller.

12. A method according to claim 10, further comprising receiving a signal representative of whether one or more stabilisers of the machine are deployed, wherein the threshold value is further dependent on the signal representative of whether one or more of the stabilisers of the machine are deployed.

13. A method according to claim 10, wherein the signal representative of the position of the load handling apparatus is a signal representative of an angle of rotation of a lifting arm of the load handling apparatus with respect to the machine body about a substantially fixed pivot.

14. A method according to claim 10, wherein the signal representative of the moment of tilt of the machine is a signal representative of the load on an axle of the machine.

15. A method according to claim 10, wherein the threshold value includes a first threshold value associated with one or more predetermined positions of the load handling apparatus and a second threshold value associated with one or more other predetermined positions of the load handling apparatus.

16. A method according to claim 15, wherein the threshold value is proportional or substantially proportional to the signal representative of a position of the load handling apparatus over a range of positions of the load handling apparatus.

17. A method according to claim 16, wherein the range of positions of the load handling apparatus is between a first and a second position of the load handling apparatus, and at least one different threshold value is used when the position of the load handling apparatus is outside of the range.

* * * * *